US006748777B1

(12) United States Patent
Livingston

(10) Patent No.: US 6,748,777 B1
(45) Date of Patent: Jun. 15, 2004

(54) REMOVABLE INTERNAL CORE PIN TUMBLER LOCK

(75) Inventor: Dwain Livingston, Sparks, NV (US)

(73) Assignee: VSR Lock, Inc., Las Vegas, NV (US)

( * ) Notice: Subject to any disclaimer, the term of this patent is extended or adjusted under 35 U.S.C. 154(b) by 0 days.

(21) Appl. No.: 10/377,391

(22) Filed: Feb. 26, 2003

(51) Int. Cl.[7] ..... E05B 33/00; E05B 27/00

(52) U.S. Cl. ..... 70/369; 70/371; 70/490; 70/493; 70/379 R

(58) Field of Search ..... 70/369, 370, 371–372, 70/367, 360, 358, 490–491, 492, 493, 379 R, 339, 340

(56) References Cited

U.S. PATENT DOCUMENTS

| | | | | | |
|---|---|---|---|---|---|
| 1,832,108 | A | | 11/1931 | Falk | |
| 1,982,813 | A | * | 12/1934 | Jacobi | 70/65 |
| 3,102,411 | A | * | 9/1963 | Friedman | 70/100 |
| 3,789,638 | A | | 2/1974 | Roberts et al. | 70/366 |
| 4,380,915 | A | * | 4/1983 | Kincaid et al. | 70/224 |
| 4,398,405 | A | | 8/1983 | Patriquin | 70/369 |
| 4,565,080 | A | * | 1/1986 | Kincaid et al. | 70/215 |
| 4,630,457 | A | * | 12/1986 | Kincaid et al. | 70/369 |
| 4,712,400 | A | | 12/1987 | Steinbach | 70/369 |
| 5,087,090 | A | * | 2/1992 | Humphrey et al. | 292/359 |
| 5,152,161 | A | | 10/1992 | Lee | 70/127 |
| 5,168,734 | A | | 12/1992 | Duval et al. | 70/369 |
| 5,634,359 | A | | 6/1997 | Huebschen | 70/379 R |
| 5,685,184 | A | | 11/1997 | Gallagher | 70/358 |
| 5,711,506 | A | * | 1/1998 | Stillwagon | 70/208 |
| 5,752,400 | A | | 5/1998 | Kim | 70/368 |
| 5,775,145 | A | | 7/1998 | Kasper | 70/367 |
| 5,873,272 | A | * | 2/1999 | Thompson | 70/100 |
| 5,907,963 | A | | 6/1999 | Myers et al. | 70/371 |
| 6,314,774 | B1 | * | 11/2001 | Andersson | 70/358 |
| 6,532,782 | B2 | * | 3/2003 | Chiu | 70/369 |

* cited by examiner

*Primary Examiner*—John B. Walsh
(74) *Attorney, Agent, or Firm*—Sierra Patent Group, Ltd.

(57) ABSTRACT

The disclosed device is directed towards a key operated lock. The key operated lock comprises a barrel defining an interior, the barrel having an alignment block at the interior. A core is insertable into the interior. The core demountably coupling with the alignment block in both a clockwise and a counterclockwise direction.

16 Claims, 7 Drawing Sheets

SECTION A–A

REMOVABLE INTERNAL CORE PIN TUMBLER LOCK

BACKGROUND OF THE INVENTION

The present disclosure relates to the field of pin tumbler locks and more particularly to a pin tumbler lock having a removable internal core.

Conventional pin tumbler cam locks comprise a core including an annular cylinder and rotary plug. The core is located within a lock housing. The plug has a row of individual tumbler pins slidable toward or away from the plug rotational axis. The annular cylinder has a corresponding row of spring-biased drive pins in registration with the tumbler pins. The drive pins are normally urged partway into the mounting holes for the tumbler pins so that the plug cannot rotate.

In the locked position, a key may be inserted into a key slot in the plug to push the tumbler pins outwardly, thereby moving the drive pins out of the tumbler pin mounting holes. These tumbler pin movements align the outer ends of the tumbler pins to become coincident with the plug outer surface. The plug can be rotated to the open position by turning the key. The plug supports a lock plate that swings behind a keeper to lock or unlock the device.

In a more sophisticated arrangement, a pin tumbler cam lock can have a multiplicity of rows of pin tumblers. The pin tumblers can be arranged in a manner in that a relatively large number of tumbler pins can be accommodated in a relatively small size lock housing. The rotary plug can have a key slot with a narrow rectangular cross-section. The mating key can have two parallel flat side surfaces and two connecting edge surfaces. Rows of conical depressions are defined in the flat side surfaces and the edge surfaces of the key. The plug has three rows of tumbler pins located in the plug in order that the pins register with the conical depressions defined in the key. The pin inner ends are conically shaped in order to mate with the conical depressions on the key.

When the key is inserted into the key slot the depressions in the key locate the tumbler pins at the correct height in the mounting holes. Spring-biased drive pins are mounted in a stationary cylinder surrounding the rotary plug to normally extend partly into the mounting holes for the tumbler pins. The key upon insertion into the plug, moves the tumbler pins outwardly to drive the drive pins out of the plug. With the drive pins free of interference, the plug can rotate freely. There are three rows of tumbler pins extending radially from the pin rotational axis. In some lock arrangements, the pins are arranged in the plug in three rows with one row containing five sets of drive pins and tumbler pins and springs. The other two rows contain six sets of drive pins, tumbler pins and springs. The arrangement has a total of seventeen sets of pins and springs for securing the lock and resisting lock picking.

The plug motion is controlled by a feature known as a stop arm or tab extending from the rear of the stationary cylinder through an aperture in the rear of the lock housing shell. The stop arm cooperates with a stop plate carried on the rotary plug and in registration with the stop arm. The stop arm is designed to limit the rotation of the stop plate in two directions. The plug position is determined by the limitation of the rotation. The plug can be positioned in the locked condition of the lock and the plug can be positioned in the unlocked condition of the lock. The single stop arm determines both end positions of the rotary plug and therefore provides for more accurate control of the plug motion. Manufacturing tolerances and tolerance build-up becomes less of an adverse factor.

The plug control through the stop arm on the exterior of the structure provides for a shorter lock length. This shorter lock length is done without the elimination of pins or tumblers.

The plug in the lock is inserted into an annular cylinder that is covered by a housing sleeve to form the core. The housing sleeve is inserted into a housing shell. The housing shell is typically inserted into a cabinet door and permanently fastened to the cabinet door. The entire lock including the fixed housing shell in the door, the rotatable plug within the cylinder and sleeve combined provide for locking the cabinet door. The housing shell has threaded side surfaces that receive a nut in order to fasten the lock onto the cabinet door. The cabinet has a keeper that is fixed to the cabinet to block the cabinet from opening. The lock has a corresponding lock plate that rotates into locked and unlocked position depending upon the relationship to the keeper on the cabinet. The lock plate is attached to the plug on the end of the plug opposite the key slot. The plug has a threaded stem that receives the lock plate and a nut to threadably tighten and fix the lock plate to the plug. The plug rotates the lock plate into and out of engagement with the keeper on the cabinet.

In order to remove the plug from the housing, the nut holding the lock plate must be removed from the threaded end of the plug. Removal of the nut can only be done when the cabinet door is open and the back of the lock is exposed for removal of the nut and lock plate. With the nut and lock plate removed, the plug, cylinder and housing sleeve, i.e., the core can be removed from within the fixed housing shell in the cabinet door.

In many lock applications, the contents of the cabinet are sensitive to exposure from the external environment, such as dust and moisture from the exterior of the cabinet. In other applications, the contents require security from unauthorized persons and tampering with the contents.

Also in many lock applications, the key for the specific lock becomes lost or must be rekeyed for security purposes. The corresponding pin and tumbler arrangement must be changed to match the new key. The lock plug and cylinder assembly (core) must be removed in order the change the pin and tumbler arrangement for the new key. The resultant problem arises with the need to remove the plug. The cabinet door must be opened creating the above mentioned environmental and security risks.

There have been lock core designs that allow for the removal of the core without the need to open the cabinet door to access the rear of the lock. These prior art locks require plug and cylinder arrangements that are bulky as well as limit the range of rotation of the plug. Additionally, after removal of the core, the replacement core would have realignment malfunctions with the lock plate or cam actuators at the back end of the lock. The weight of the lock plate may cause the lock plate to inadvertently rotate out of alignment with the replacement plug. The plug is also limited to only a left handed turn or limited to only a right handed turn, (clockwise, counterclockwise) so that the lock can only be installed in a cabinet door with the hinges on the left or only installed in a cabinet door with the hinges on the right.

What is needed in the art is a compact lock with a removable plug that can rotate in any direction with full range of rotation that does not require the locked cabinet door to be opened for the removal of the plug as well as a replacement core that will realign in the lock housing with ease.

SUMMARY

The disclosed device is directed towards a key operated lock. The key operated lock comprises a barrel defining an interior, the barrel having an alignment block at the interior. A core is insertable into the interior. The core demountably coupling with the alignment block in both a clockwise and a counterclockwise direction.

In another embodiment the disclosed device is directed towards a key operated lock comprising a barrel defining an interior and an exterior, the barrel having a front end and a rear end opposite thereof. The barrel defining an alignment block in the interior proximate to the rear end. A core is demountably insertable in the interior of the barrel. The core comprises an inner inserted rotatable into an outer. A retainer is disposed over the inner proximate to a rear of the inner and inserted rotatable into the outer at a rear of the outer. A sleeve is disposed over the outer and configured to retain a plurality of drive pin and spring sets disposed through the outer. The plurality of drive pin and spring sets being in operable communication with a corresponding tumbler pin disposed through the inner, wherein the retainer demountably couples with the alignment block in both a clockwise and counter-clockwise direction.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons having the benefit of this disclosure.

Figure 1:
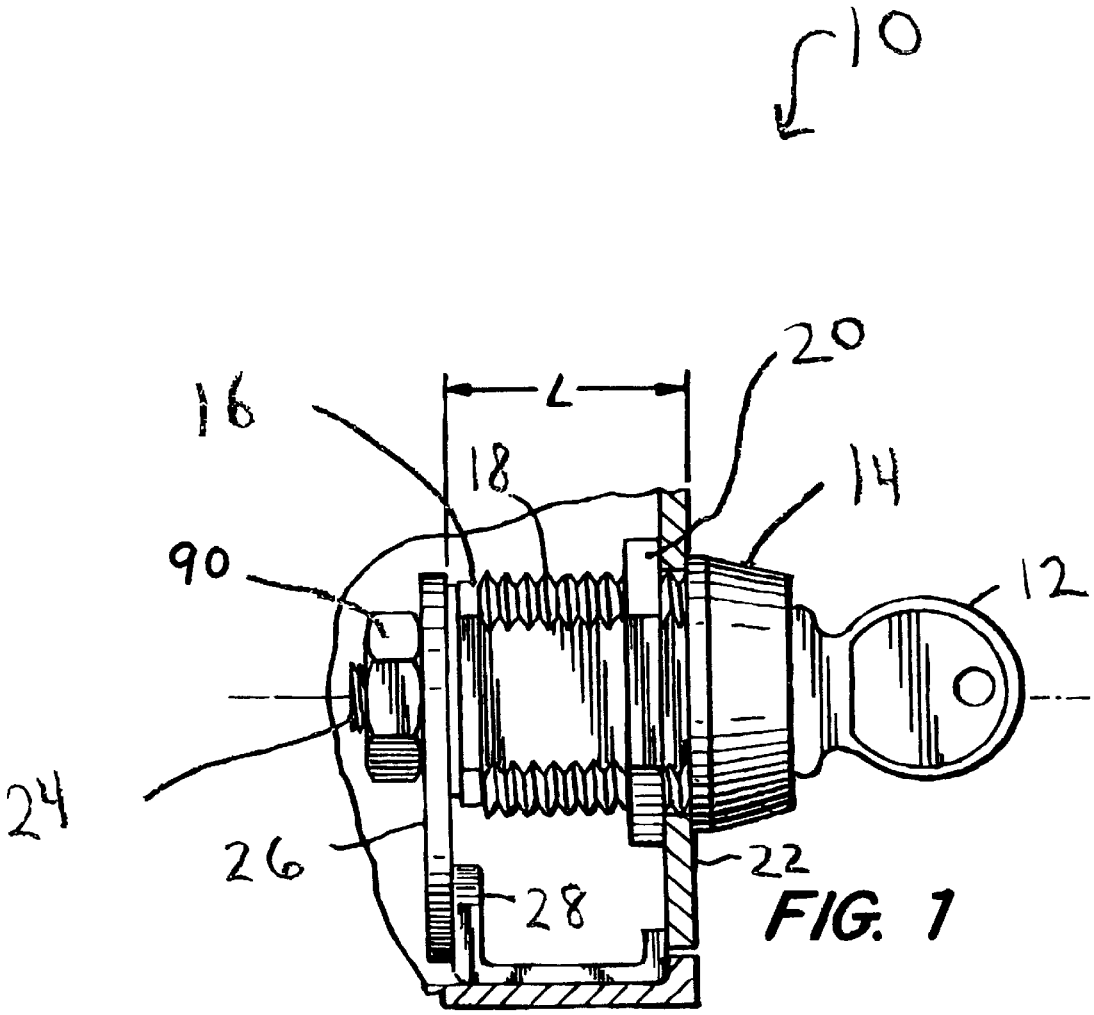
FIG. 1 is a side view schematic of an exemplary lock.

FIG. 1 illustrates a side view schematic of an exemplary lock 10. The lock 10 is operated with a key 12. The lock 10 comprises a housing shell or barrel 14 having an exterior 16 with a threaded side surface 18 adapted to receive a nut 20, whereby the barrel 14 can be mounted on a structure 22, for example, the structure can be the outer door of a vending or gaming machine. The dimension indicated at L is known in the art as a locking dimension. In exemplary embodiments the locking dimension can be substantially shortened. The lock 10 includes a tailpiece 24 that carries a lock plate 26.

As shown in FIG. 1, the lock plate 26 extends downwardly to engage a fixed keeper 28, whereby the lock 10 is in a locked condition to prevent rightward motion of structure (door) 22. The key 12 is insertable into a key slot 30 (shown at FIG. 2) in a plug or inner 32 to rotate the inner 32 to lock or unlock the lock 10. The key 12 is removable from the key slot 30 only when the lock is in a locked condition.

Figure 2:
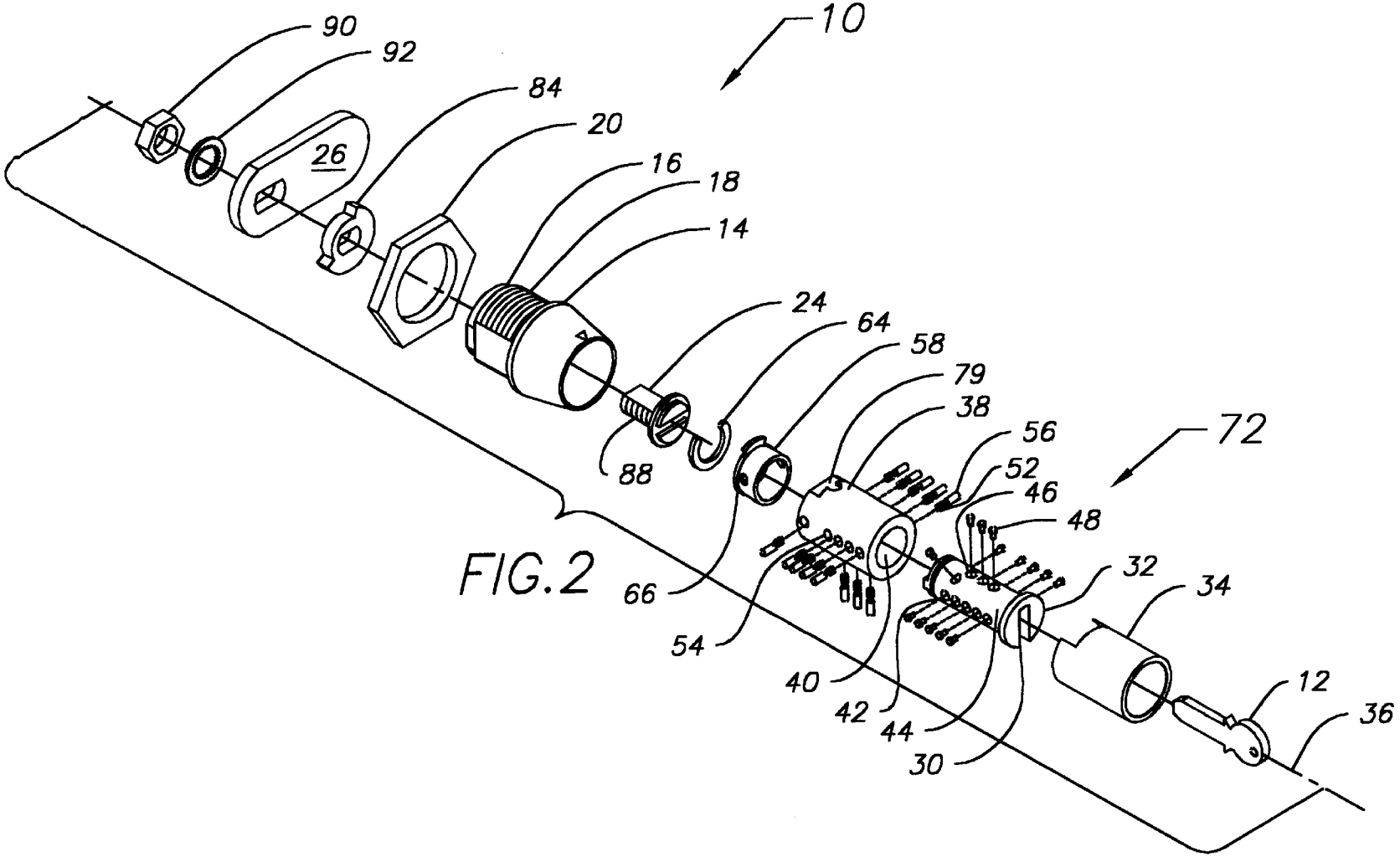
FIG. 2 is an exploded perspective view of an exemplary lock.
Figure 5:
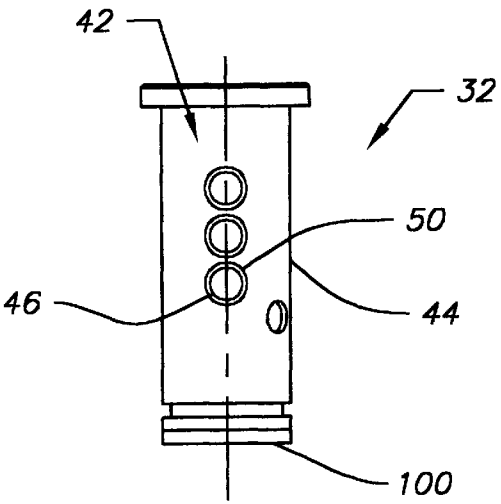
FIG. 5 is a top view of an exemplary inner.
Figure 4:
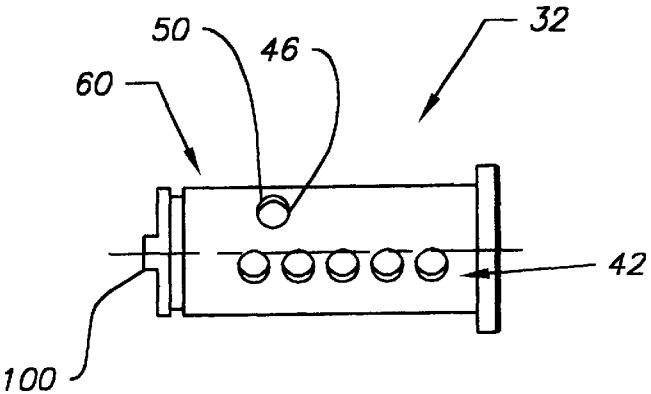
FIG. 4 is a side view of an exemplary inner.
Figure 3:
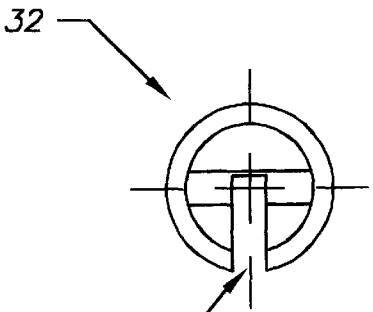
FIG. 3 is a front view of an exemplary inner.
Figures 6, 7, 8:
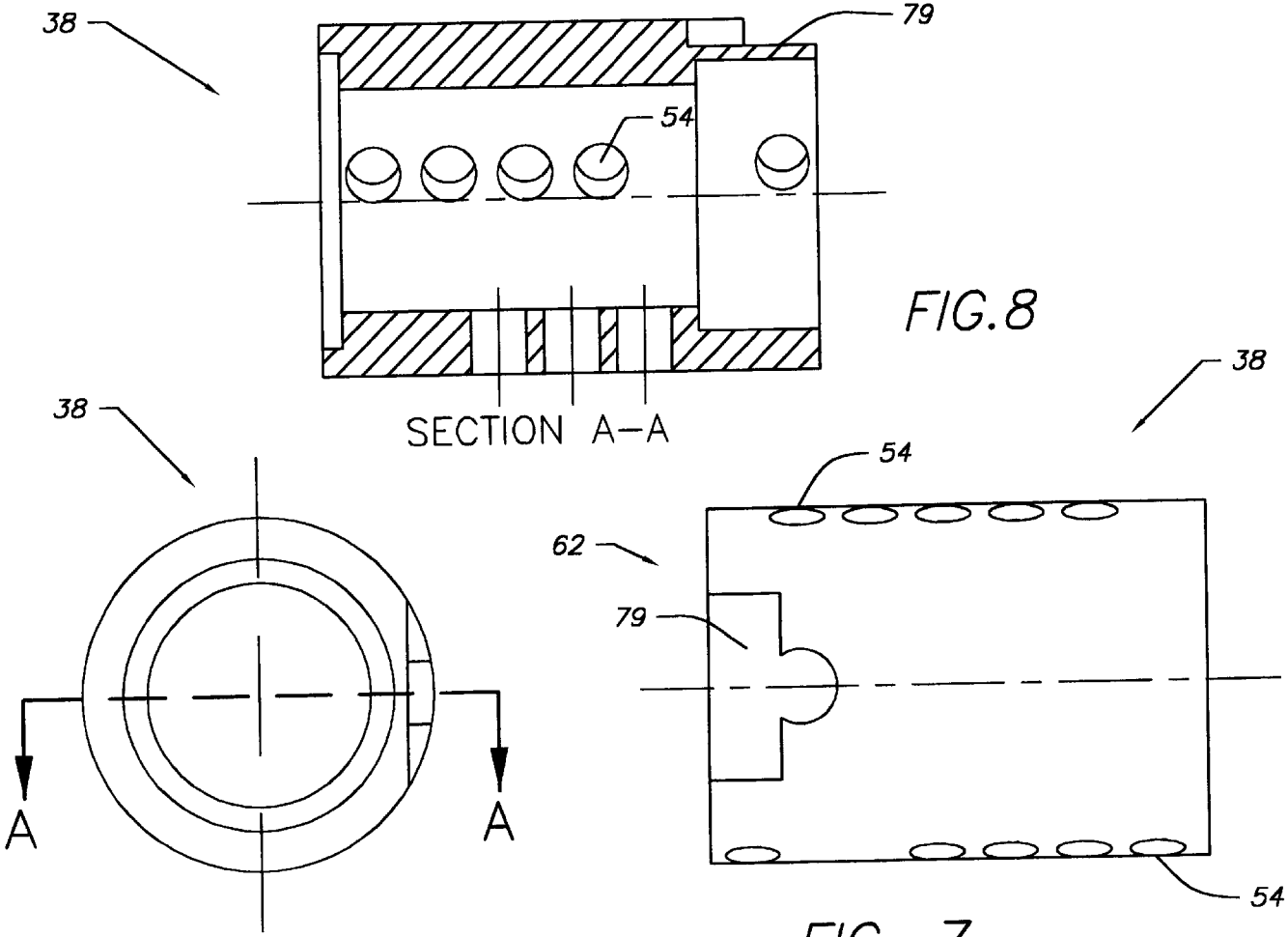
FIG. 6 is a front view of an exemplary outer.
FIG. 7 is a top view of an exemplary outer.
FIG. 8 is a sectional view of an exemplary outer as shown in FIG. 6.
Figure 10:
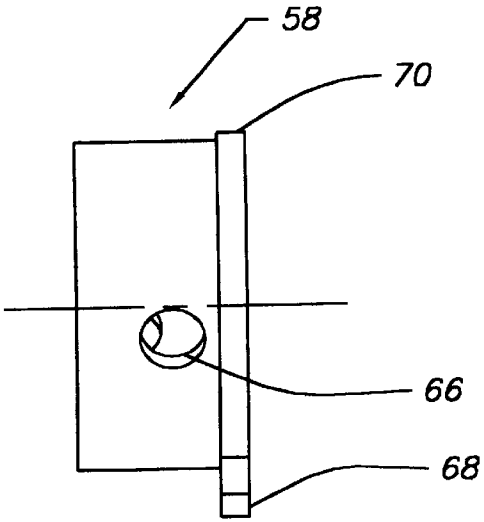
FIG. 10 is a side view of an exemplary retainer.
Figure 11:
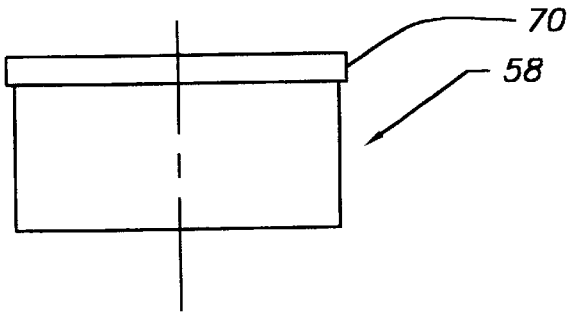
FIG. 11 is a top view of an exemplary retainer.
Figure 9:
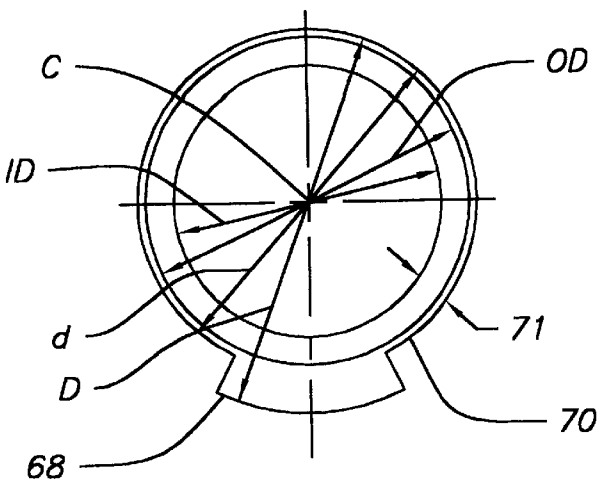
FIG. 9 is a front view of an exemplary retainer.
Figure 15:
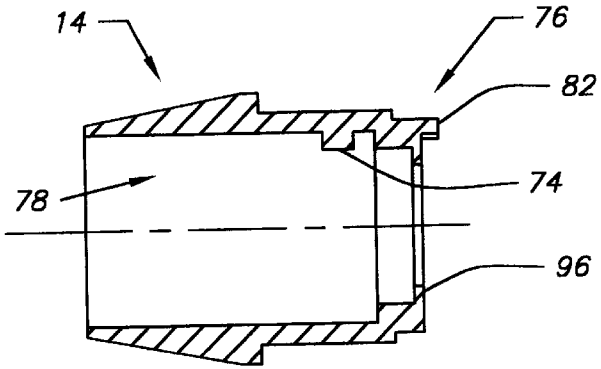
FIG. 15 is a sectional view of an exemplary barrel as shown in FIG. 14.
Figure 13:
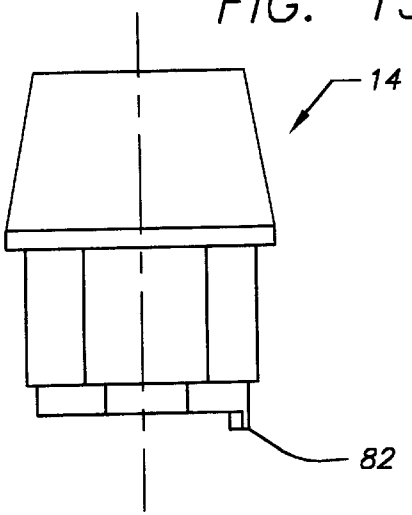
FIG. 13 is a side view of an exemplary barrel.
Figure 14:
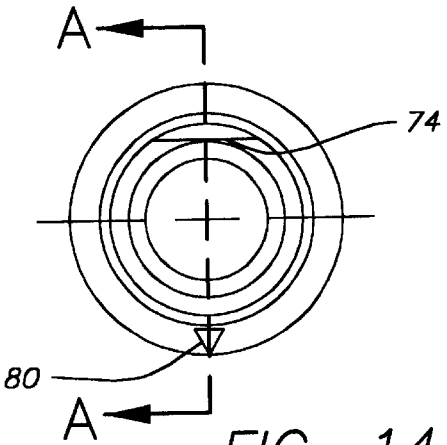
FIG. 14 is a front view of an exemplary barrel.
Figure 12:
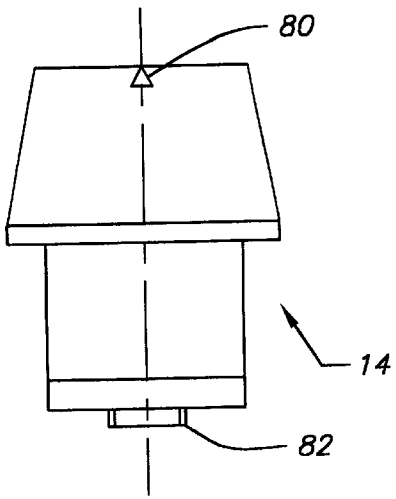
FIG. 12 is a top view of an exemplary barrel.
Figure 17:
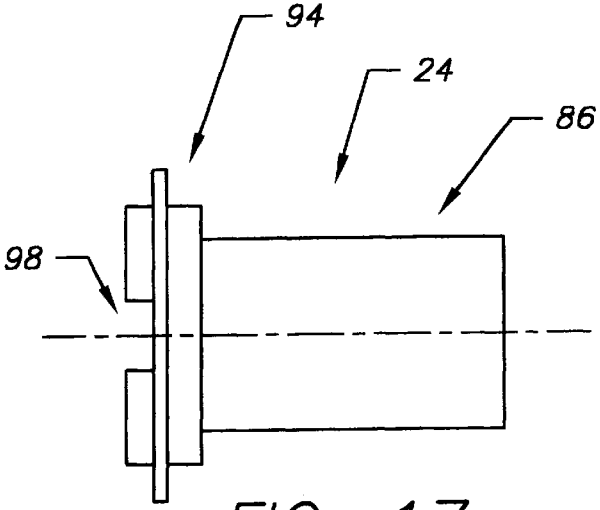
FIG. 17 is a side view of an exemplary tail piece.
Figure 18:
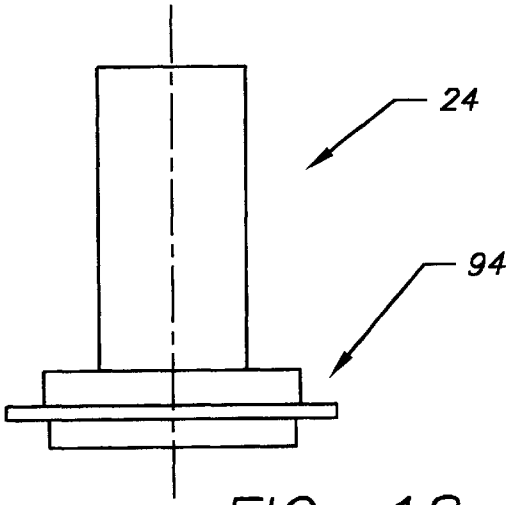
FIG. 18 is a top view of an exemplary tail piece.
Figure 16:
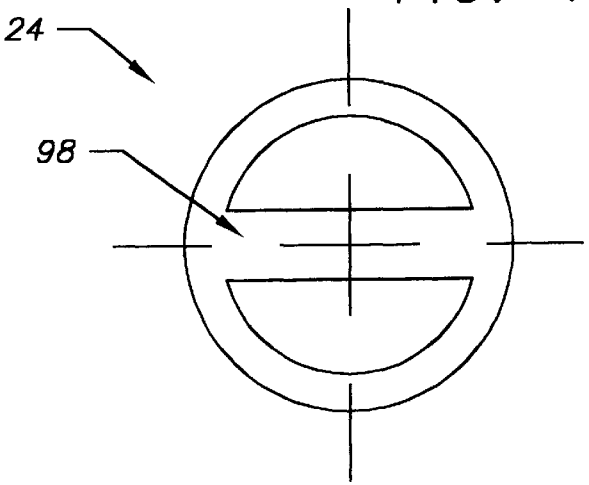
FIG. 16 is a front view of an exemplary tail piece.

FIG. 2 illustrates an exploded perspective view of an exemplary lock 10. The lock 10 comprises a housing sleeve or simply sleeve 34 telescoped into barrel 14. In an exemplary embodiment, the housing sleeve 34 is steel. The purpose of the sleeve 34 is to provide a sleeve inner surface that is precisely centered relative to a lock rotational axis 36, whereby the positions of the internal components are precisely controlled in relation to the rotational axis 36. Barrel 14 can be a zinc die casting without precision surfaces.

Mounted within sleeve 34 is an annular cylinder or simply an outer 38. In a preferred exemplary embodiment the outer 38 is formed of brass. The outer 38 is disposed over the inner 32. The outer 38 has an inner cylindrical surface 40 that acts as a bearing for the inner 32. The inner 32 is inserted into the outer 38 allowing rotary motion relative to the outer 38. Inner 32 may also be formed of brass. The inner 32 is adapted to rotate about the rotational axis 36. The key slot 30 extends longitudinally within inner 32 in generally parallel relation to the rotational axis 36, whereby when key 12 is inserted into the slot 30 the key is able to rotate the inner 32 about the rotational axis 36.

The inner 32 has three rows of holes 42 extending from an outer surface 44 to the key slot 30. FIG. 2 shows two rows of holes 42 in the inner 32. A third row of holes extends from the non-visible surface of the inner 32. As shown in FIGS. 2–5, each row contains five or six holes 46 for a total of seventeen holes in the inner 32. Each hole 46 is designed to slidably receive a tumbler pin 48.

A representative hole 46 has a counter bore 50 designed to accommodate the enlarged head of the associated tumbler pin 48. The shank portion of each tumbler pin has a conical inner end. When the key 12 is inserted into the key slot 30, conical depressions in the key surfaces mate with the conical ends of the tumbler pins to move the pins outwardly in their mounting holes 46. When the key 12 is withdrawn from slot 30 the tumbler pins 48 are driven toward the rotational axis 36 into the slot 30. Shoulder surfaces of counterbores 50 limit movements of pins 48 toward the slot 30.

The outer 38 includes drive pins 52 that are slidably mounted in socket holes 54 in the outer 38 (See FIGS. 2 and 6–8). A spring or generally a biasing member 56 is associated with each drive pin 52. The biasing members 56 bias the drive pins 52 to provide the necessary forces to move the tumbler pins 48 toward the key slot 30. When key 12 is removed from slot 30 each drive pin 52 extends part way into the associated counterbore 50 of inner 32, preventing the inner 32 from rotating within the outer 38.

The shank portions of the tumbler pins 48 have the same length. However, the head portions of the tumbler pins 48 may have varying lengths. In a representative structure four different head lengths are used—i.e., 1.79 mm., 1.44 mm., 1.09 mm., and 1.34 mm. Each pin 48 has one of such head dimension. The conical depressions in the key surfaces vary in depth, whereby when key 12 is inserted into the key slot 30 all of the tumbler pins 48 are forced outwardly in their respective mounting holes 46 to positions wherein all of the drive pins 52 are out of counter bores 50. The key then can be turned to rotate the inner 32 to the unlocked condition or back to the locked condition.

Referring to FIGS. 2–11, retainer 58 is disposed over the inner 32 proximate to a rear 60 of said inner 32. The retainer 58 is also insertable into the outer 38 proximate to a rear 62 of the outer 38. The retainer 58 is movable about the inner 32 as well as movable within the outer 38 in a rotary motion. The rotary motion can be both clockwise and counterclockwise. A retaining clip 64 holds the retainer to the inner 32 while allowing for rotation of the retainer 58. The retainer 58 includes sockets or pin holes 66 for receiving tumbler pins 48 biased and driven by biasing members 56 and drive pins 52 respectively. The retainer 58 is restricted or released to rotate about the inner by the drive pin and tumbler pin sets. In a preferred exemplary embodiment, there is any number of and at least one drive pin and tumbler pin associated with the retainer 58. The retainer 58 includes a retaining ear 68 defined in the retainer 58. The retaining ear 68 can be formed at an end of the retainer 58. In a preferred exemplary embodiment, the retaining ear 68 is machined to form an extension portion of an end flange 70. The end flange 70 includes a diameter d and the retaining ear includes a diameter D that is larger than the diameter d through the centerline C of the retainer 58. The retainer 58 includes an inner diameter ID and an outer diameter OD. The outside diameter OD can vary from the diameter of the flange d and the retaining ear diameter D. The difference between the inner diameter ID and the outside diameter OD, called the difference 71, allows for the retainer 58 to be operated without a wafer (not shown). The retainer 58 requires no special wafer in order to operate with a core key. No wafers are required since the difference 71 can be changed in thickness in order to accommodate various key tumbler combinations. The dimensions of the difference 71 is maintained in whole number dimensions not to exceed the numerical difference between the longest and shortest tumbler pins used in the lock for the retainer 58.

The combination of inner 32, the outer 38 including all the drive pin/spring sets and tumbler pins covered by the sleeve 34 and including the retainer 58 are collectively called the core 72. The core 72 is demountably inserted/removed from the barrel 14. The core 72 is removable in order that the combinations of tumblers to key sets can be varied to prevent compromising the lock 10. As described above, the removable core 72 allows for a rapid and simple change of the lock/key set. The core 72 facilitates the change without the need to open the structure 22 that is held shut by the lock. The core 72 is inserted and removed with the core key. The retainer 58 maintains the core 72 inside the barrel 14 as well as releases the core 72 from the barrel 14. The retainer 58 rotates into a position to couple to the barrel 14.

Referring to FIGS. 12–15 the multiple views of an exemplary embodiment of the barrel 14 are illustrated. The barrel 14, as described above at FIG. 1, is adapted to be fixed in place by nut 20 and secured to the structure 22. The barrel 14 does not rotate relative to the structure 22. The core 72, as well as the retainer 58, is rotatable within the barrel 14. The barrel 14 defines an alignment block 74 located proximate to a rear 74 of the barrel 14. In other embodiments, the alignment block 74 can be located at any distance from the rear 74. The alignment block 74 forms a tab or indent into an interior 78 of the barrel 14. In a preferred exemplary embodiment, the alignment block 74 is formed from the same material as the barrel 14. The alignment block 74 cooperates with the retainer 58 to secure the core 72 in the interior 78 of the barrel 14. A slot 79 is formed on the outer 38 to allow for the outer to insert into the barrel 14 without interfering with the alignment block 74. An alignment marker 80 is defined in the barrel 14. The alignment marker 80 is configured to indicate the position of the alignment block 74 within the barrel 14 to facilitate the ease of insertion of the core 72. In a preferred exemplary embodiment, the alignment marker 80 is a notch formed in the barrel 14 at a conspicuous location distal from the rear of the barrel 76. The barrel 14 includes a stop tab 82 formed from the barrel 14 at the rear of the barrel 76. The stop tab 82 cooperates with a force plate 84 (See FIG. 2). The force plate 86 abuts the stop tab 82 and inhibits the rotation of the tailpiece 24.

Referring to FIGS. 2 and 16–18 an exemplary embodiment of the tailpiece is illustrated. The tailpiece 24 includes an exterior 86 having a threaded side surface 88 for securing the force plate 84 along with the lock plate and associated tailpiece nut 90 securing the assembly together. A tailpiece washer 92 can be included between the tailpiece nut and the lock plate 26. The tailpiece 24 is normally in operable communication with the core 72 and is separate and distinct from the core 72. The tailpiece 24 is insertable into the barrel 14 at the interior of the barrel 78 proximate to the rear of the barrel 76. A flange or head 94 on the tailpiece 24 cooperates with a tailpiece flange 96 defined at the rear of the barrel 76. The tailpiece 24 is mounted in the barrel 14 and rotates within the barrel 14. The tailpiece 24 includes a groove formed proximate to the head 94. The groove 98 is configured to couple with a drive element 100 formed at the rear of the inner 60. The drive element 100 and groove 98 cooperate to transfer the rotational motion from the key 12 through the inner 32 to the tail piece 24 to rotate the lock plate 26. The lock plate 26 when rotated clockwise and/or counterclockwise locks or unlocks the lock 10. The groove 98 on the tailpiece can be formed with adaptive features such as bevels, notches and cross notches, and the like. The drive element 100 can have similar features that maintain coupling between the tailpiece 24 and the inner 32. The alignment marker 80 can enhance the coupling between the tailpiece 24 and the inner 32. In an exemplary embodiment, the groove 98 is a rectilinear slot and the drive element 100 is a rectilinear tab. The mating of the slot and tab be enhanced by registering the alignment marker 80 with the orientation of the key 12 that results in mating orientation of the groove 98 and the drive element 100. Since the tailpiece 24 and the core 72 are independently constructed, the core 72 can be removed and inserted without the need to open or expose the lock plate 26 or tailpiece nut 90 from outside the structure 22. The assembled tailpiece nut 90, lock plate 26, and force plate 84 disposed over the tail piece 24 does not have to be disassembled in order to remove the core 72. A core change out can be accomplished with the tailpiece 24 and attached components in place at the rear of the barrel 14. The lock plate 26 can remain secured to the fixed keeper 28, securing the contents of the structure 22 and eliminating the risks of exposure to the outside environment.

In another exemplary embodiment, the lock 10 can merely include the core 72 insertable into the barrel 14. The inner 32 includes an extended drive element 100 configured to actuate a control arm 102 (see FIG. 1) or control actuator 102 adapted to actuate a control element 104 such as a switch or actuator and the like. The lock 10 can be employed to actuate an electronic control circuit (not shown) or actuate some other device separate from or in addition to providing a barrier to lock the structure 22.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A key operated lock comprising:

a barrel defining an interior and an exterior, said barrel having a front end and a rear end opposite thereof, said barrel defining an alignment block in said interior proximate to said rear end; and a core demountably insertable in said interior of said barrel, said core comprising an inner inserted rotatable into an outer, a retainer is disposed over said inner proximate to a rear of said inner and inserted rotatable into said outer at a rear of said outer, a sleeve is disposed over said outer and configured to retain a plurality of drive pin and spring sets disposed through said outer, said plurality of drive pin and spring sets being in operable communication with a corresponding tumbler pin disposed through said inner, wherein said retainer demountably couples with said alignment block in both a clockwise and counter-clockwise direction.

2. The lock of claim 1 further comprising:

a tailpiece disposed in said barrel proximate to said rear end of said barrel, said tailpiece is configured to operatively couple to a rear of said inner, wherein rotary force is transferred between said inner and said tailpiece.

3. The lock of claim 2 further comprising:

a force plate disposed over said tail piece outside of and proximate to said rear end of said barrel, said force plate cooperates with a portion of said barrel at said rear of said barrel to limit rotation of said tail piece.

4. The lock of claim 2 further comprising:

a lock plate is disposed on said tail piece and fixed to said tailpiece.

5. The lock of claim 1 further comprising:

an alignment marker located on said exterior at a front end of said barrel, said alignment marker configured to provide indication of alignment of said core in said interior of said barrel.

6. The lock of claim 5 wherein said alignment of said core in said interior of said barrel includes said retainer aligning with said alignment block.

7. The lock of claim 1 wherein said inner defines a key slot, said inner defining at least one row of pin holes extending radially from said key slot through said inner and said inner defines a drive element proximate said rear of said inner.

8. The lock of claim 7 wherein said outer defines at least one row of socket holes through said outer, said at least one row of socket holes configured to receive said pin and spring sets, said socket holes being configured to register with said pin holes.

9. The lock of claim 1 wherein said sleeve is configured to be rotatable in said barrel.

10. The lock of claim 1 wherein said retainer defines at least one pin hole for receiving at least one pin.

11. The lock of claim 1 wherein said retainer defines a retaining ear configured to engage said alignment block, wherein said core is configured to retain in said barrel responsive to said retaining ear engaging said alignment block, wherein said core is configured to be releasable from said barrel responsive to said retaining ear disengaging said alignment block.

12. The lock of claim 1 wherein said retainer is configured to operate in the absence of wafers.

13. The lock of claim 1 wherein said retainer defines an interior cavity having a inner diameter and an exterior having an outside diameter, said inner diameter and said outside diameter defining a difference.

14. The lock of claim 1 wherein a tailpiece defines a groove element configured to receive a drive element of said inner.

15. The lock of claim 14 wherein said groove element is beveled to guide said drive element responsive to insertion of said drive element into said groove element.

16. The lock of claim 1 wherein said inner is configured to actuate controls in the absence of a tail piece.

* * * * *